US007096668B2

(12) United States Patent
Martling et al.

(10) Patent No.: US 7,096,668 B2
(45) Date of Patent: Aug. 29, 2006

(54) COOLING AND SEALING DESIGN FOR A GAS TURBINE COMBUSTION SYSTEM

(76) Inventors: Vincent C. Martling, 10296 Sandy Run Rd., Jupiter, FL (US) 33478; Zhenhua Xiao, 195 Lone Pine Dr., Palm Beach Gardens, FL (US) 33420

( * ) Notice: Subject to any disclaimer, the term of this patent is extended or adjusted under 35 U.S.C. 154(b) by 0 days.

(21) Appl. No.: 10/744,423

(22) Filed: Dec. 22, 2003

(65) Prior Publication Data

US 2005/0132708 A1 Jun. 23, 2005

(51) Int. Cl.
*F02C 1/00* (2006.01)
*F02G 3/00* (2006.01)

(52) U.S. Cl. ..... 60/757; 60/770; 60/800; 60/754

(58) Field of Classification Search ..... 60/770, 60/39.37, 752–760, 796–800, 805–806
See application file for complete search history.

(56) References Cited

U.S. PATENT DOCUMENTS

| | | | | | |
|---|---|---|---|---|---|
| 2,578,481 | A | * | 12/1951 | Lombard | 60/39.37 |
| 3,609,968 | A | * | 10/1971 | Mierley et al. | 60/799 |
| 4,195,474 | A | * | 4/1980 | Bintz et al. | 60/730 |
| 4,527,397 | A | | 7/1985 | Tobery et al. | |
| 4,719,748 | A | | 1/1988 | Davis, Jr. et al. | |
| 5,081,843 | A | | 1/1992 | Ishibashi et al. | |
| 5,239,831 | A | * | 8/1993 | Kuroda et al. | 60/733 |
| 5,274,991 | A | * | 1/1994 | Fitts | 60/800 |
| 5,400,586 | A | * | 3/1995 | Bagepalli et al. | 60/800 |
| 5,415,000 | A | * | 5/1995 | Mumford et al. | 60/747 |
| 5,735,126 | A | * | 4/1998 | Schulte-Werning | 60/732 |
| 5,850,731 | A | * | 12/1998 | Beebe et al. | 60/778 |
| 5,906,093 | A | * | 5/1999 | Coslow et al. | 60/777 |
| 6,334,310 | B1 | | 1/2002 | Sutcu et al. | |
| 6,640,547 | B1 | * | 11/2003 | Leahy, Jr. | 60/752 |
| 6,732,528 | B1 | * | 5/2004 | Akagi et al. | 60/752 |
| 6,792,763 | B1 | * | 9/2004 | Sileo et al. | 60/796 |

FOREIGN PATENT DOCUMENTS

| | | | |
|---|---|---|---|
| EP | WO 98/16764 | * | 4/1998 |
| GB | 2247521 A | * | 3/1992 |
| JP | 08285284 A | * | 11/1996 |
| JP | 200271136 A | * | 3/2002 |
| JP | 2003028358 A | * | 1/2003 |

* cited by examiner

*Primary Examiner*—William H. Rodriguez

(57) ABSTRACT

An interface region between a combustion liner and a transition duct of a gas turbine combustor is disclosed having improved cooling such that component life is increased and metal temperatures are lowered. An aft end of a combustion liner is telescopically received within the transition duct such that a combustion liner seal is in contact with an inner wall of the transition duct inlet ring. Increasing the dedicated cooling air supply to the combustion liner aft end, coupled with a modified combustion liner aft end geometry, significantly reduces turbulence and flow re-circulation, thereby resulting in lower metal temperatures and increased component life. Multiple embodiments of the interface region are disclosed depending on the amount of cooling required.

21 Claims, 8 Drawing Sheets

COOLING AND SEALING DESIGN FOR A GAS TURBINE COMBUSTION SYSTEM

BACKGROUND OF THE INVENTION

1. Field of the Invention

This invention relates to a gas turbine combustor and more specifically to an improved cooling configuration for an interface region between a combustion liner and a transition duct.

2. Description of Related Art

A gas turbine engine typically comprises a multi-stage compressor, which compresses air drawn into the engine to a higher pressure and higher temperature. A majority of this air passes to the combustors, which mixes the compressed heated air with fuel and contains the resulting reaction that generates the hot combustion gases. These gases then pass through a multi-stage turbine, which drives the compressor, before exiting the engine. In land-based gas turbines, the turbine is also coupled to a generator for generating electricity.

For land-based gas turbine engines, often times a plurality of combustors are utilized. Each of the combustion systems include a case that serves as a pressure vessel containing the combustion liner, which is where the high pressure air and gas mix and react to form the hot combustion gases. The hot combustion gases exit the combustion liner and pass through a transition duct, which directs the flow of gases into the turbine. The transition duct is typically surrounded by a plenum of cooling air that exits from the compressor and cools the transition duct prior to being directed towards the combustor inlet for mixing with fuel in the combustion liners. An example of a gas turbine combustor of this configuration is shown in cross section in FIG. 1. Combustor 10 comprises an outer casing 11, a combustion liner 12 located within outer casing 11, and an end cover 13 fixed to outer casing 11, wherein end cover 13 includes a plurality of fuel nozzles 14 for injecting fuel into combustion liner 12. Located between combustion liner 12 and turbine 15 is a transition duct 16, which transfers the hot combustion gases from the combustion liner to the turbine.

In operation, compressed air, which is represented by the arrows in FIG. 1, exits from a compressor into plenum 17 and passes around transition duct 16, cooling the transition duct outer wall 18, before passing between outer casing 11 and combustion liner 12 where it cools combustion liner outer wall 19. Finally the compressed air mixes with fuel from fuel nozzles 14 and combusts inside combustion liner 12.

Due to the high temperatures inherent with the combustion process, it is important to provide sufficient cooling to the combustion hardware in order to maintain its durability. One particular region where this is especially important is the interface between the combustion liner and the transition duct, which is shown in greater detail in FIG. 2. Combustion liner 12 is inserted within transition duct 16, with combustion liner 12 having at least one seal 20 for engagement with transition duct 16. Although seal 20 is designed to prevent large quantities of cooling air from entering transition duct 16 from plenum 17, it is desirable for a controlled amount of cooling air to pass through channel 21 located between combustion liner 12 and transition duct 16 to cool the outer aft end surface of combustion liner 12. Poor cooling at the combustion liner aft end results in higher combustion liner metal temperatures and more interference between seal 20 and transition duct 16 due to larger amounts of thermal growth by liner 12 and seal 20. A greater interference between mating parts results in increased wear to the seal requiring premature replacement.

Another feature found in the aft end of prior art combustion liners is deflector 22, which is a circumferential plate located within combustion liner 12 that is angled inward and deflects hot combustion gases away from the liner aft end region and is intended to reduce the amount of hot combustion gases that would otherwise re-circulate back into channel 21 between the combustion liner and transition duct. By altering the flow path of the hot combustion gases, the flow is also better mixed.

However, the hot gas flow that has been redirected by deflector 22 tends to adversely affect the heat transfer on the transition duct and first stage turbine vanes and increase their metal temperatures, thereby reducing their component life. The large regions of turbulence created by deflector 22 results in some combustion gases inadvertently being re-circulated back into channel 21, thereby blocking the small amount of cooling air currently supplied to the channel. As a result of this re-circulation effect, less cooling of seal 20 occurs and higher metal temperatures for combustion liner 12 and transition duct 16 are present. It has been determined that the primary benefit of the deflector, that is redirecting the hot combustion gas flow away from the combustion liner aft end, is not sufficient enough itself to reduce metal temperatures of the combustion liner aft end and prevent excessive wear to seal 20. Therefore modifications to enhance the cooling effectiveness as well as to eliminate unnecessary regions of high turbulence that contribute to high combustion liner metal temperatures are required.

SUMMARY AND OBJECTS OF THE INVENTION

The present invention seeks to overcome the shortcomings of the prior art by providing an interface region between a combustion liner and a transition duct of a gas turbine combustor having improved cooling such that metal temperatures are lowered and component life is increased. These improvements are accomplished by altering various features of the interface region. Specifically, the cooling air supply to the interface region can be increased and the inflow, or re-circulation, of hot combustion gases into the interface region can be minimized. Depending on the desired improvement in cooling efficiency, these adjustments can be combined into multiple embodiments.

In each embodiment, the transition duct has an inlet ring with a first forward end, a first aft end, and a first plurality of cooling holes proximate the first aft end with the cooling holes directing a cooling fluid, typically air, onto a second aft end of a combustion liner. The combustion liner also includes a second forward end, which receives a plurality of fuel injectors, and at least one outer seal, which is fixed to the combustion liner outer wall at an attachment region that is proximate the second aft end. The combustion liner is telescopically received within the transition duct such that the seal is in contact with the inner wall of the transition duct inlet ring. Dedicated cooling air to the combustion liner aft end is increased in each of the embodiments, and in multiple embodiments, is coupled with a modified liner aft end geometry that results in significantly reduced turbulence and flow re-circulation, leading to lower metal temperatures and increased component life, especially for the seal between the combustion liner and the transition duct.

It is an object of the present invention to provide an interface region between a combustion liner and a transition duct for a gas turbine combustor having improved cooling and lower metal temperatures.

It is a further object of the present invention to provide multiple cooling hole arrangements for the interface region between a combustion liner and transition duct.

In accordance with these and other objects, which will become apparent hereinafter, the instant invention will now be described with particular reference to the accompanying drawings.

DETAILED DESCRIPTION OF THE PREFERRED EMBODIMENT

Figure 1:
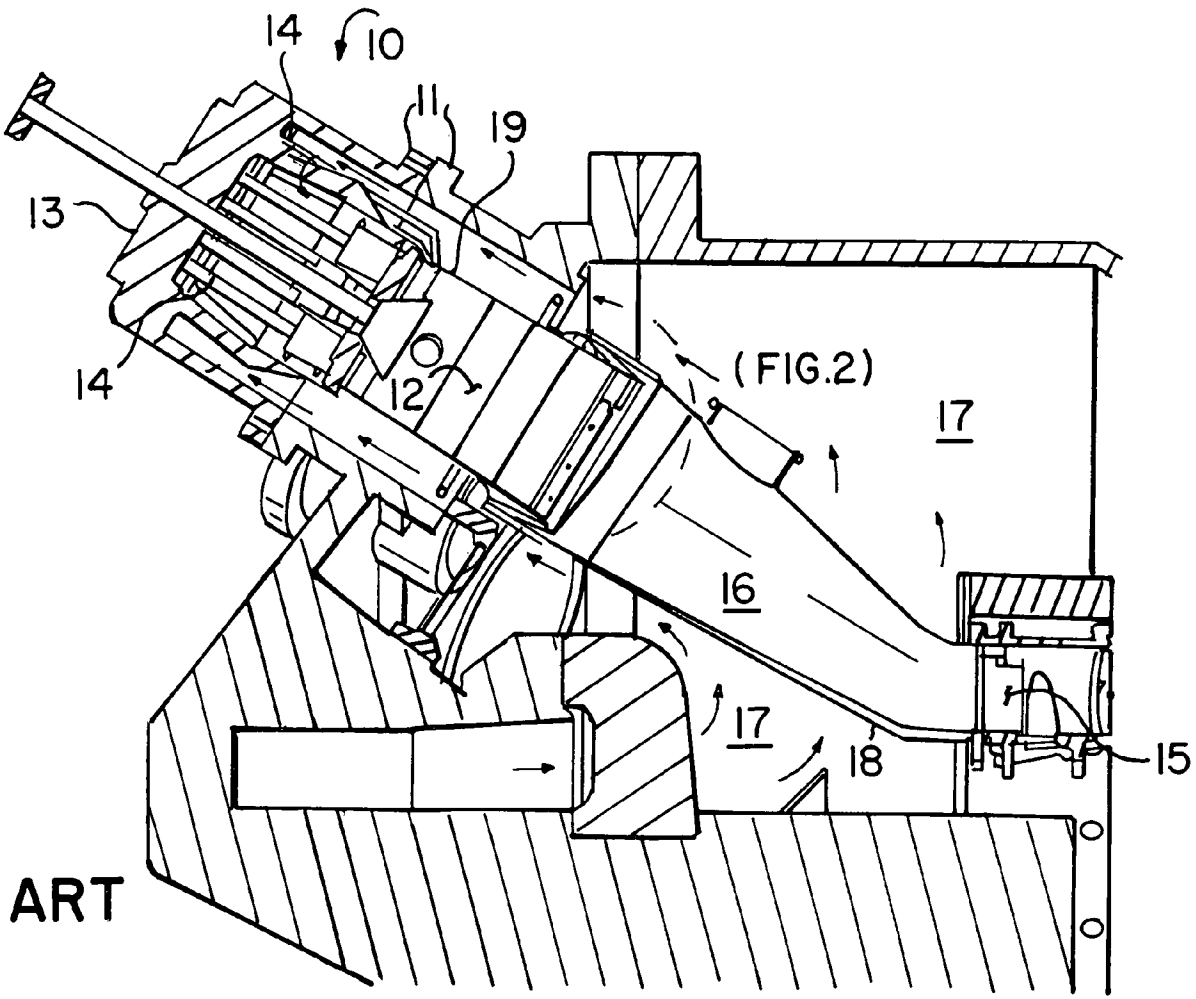
FIG.1 PRIOR ART
FIG. 1 is a cross section view of a gas turbine combustor of the prior art.
Figure 2:
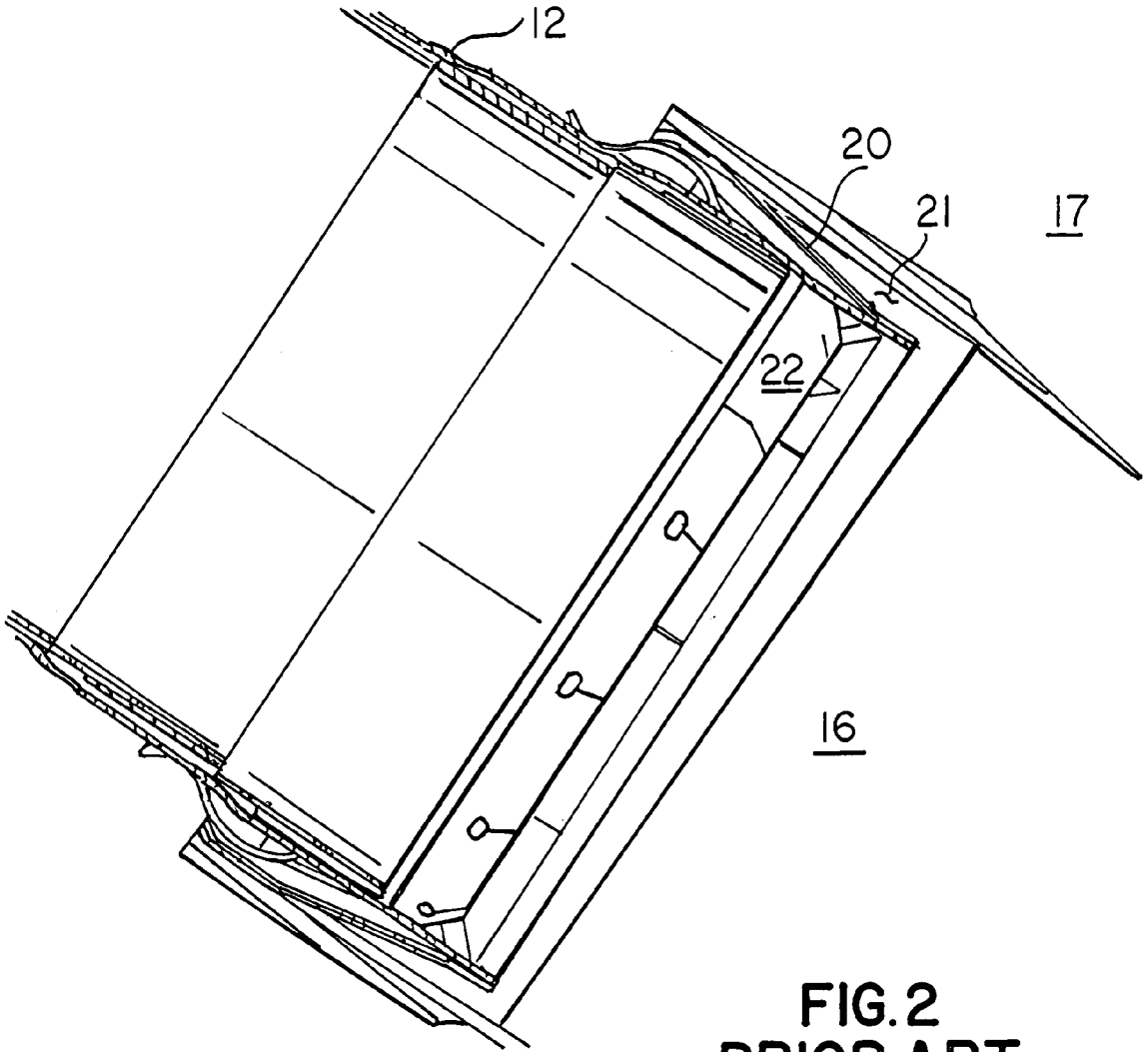
FIG. 2 PRIOR ART
FIG. 2 is a detailed cross section view of the interface region between a combustion liner and a transition duct for a gas turbine combustor of the prior art.
Figure 3:
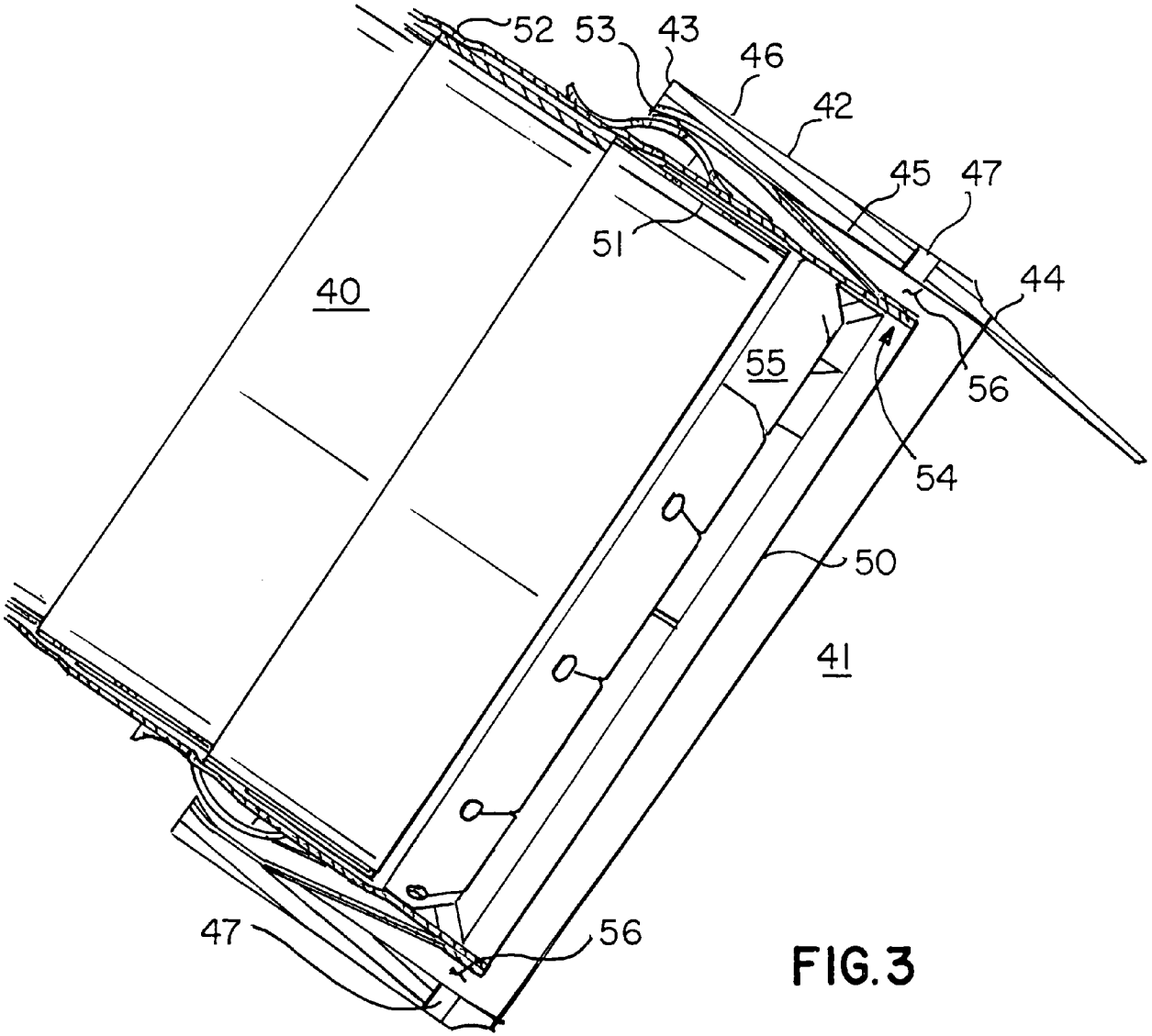
FIG. 3 is a detailed cross section view of the interface region between a combustion liner and a transition duct for a gas turbine combustor in accordance with the preferred embodiment of the present invention.

The present invention is shown in multiple embodiments in FIGS. 3 through 8. The preferred embodiment of the present invention comprises an interface region between a combustion liner 40 and a transition duct 41 having improved cooling. The combustion liner and transition duct disclosed in the preferred embodiment can be used in a combustor similar to that shown in FIG. 1. Transition duct 41 has an inlet ring 42 that has a first forward end 43, a first aft end 44, a first inner wall 45, a first outer wall 46, and a first plurality of cooling holes 47 that extend from first outer wall 46 to first inner wall 45 and are proximate first aft end 44 of inlet ring 42. Inserted telescopically within inlet ring 42 of transition duct 41 is combustion liner 40 having a second forward end with a plurality of receptacles for a plurality of fuel injectors and a second aft end 50 located within inlet ring 42 of transition duct 41. Combustion liner 40 also has a second inner wall 51, a second outer wall 52, and at least one outer seal 53 that is fixed to combustion liner 40 along second outer wall 52 at an attachment region 54 that is proximate second aft end 50. Located towards second aft end 50 is a deflector ring 55 that is fixed to second inner wall 51. Deflector ring 55, which is similar to ring 22 of the prior art, is a circumferential plate located within combustion liner 40 that is angled inward and deflects hot combustion gases away from the liner aft end region. As a result, the flow of hot gases is disturbed and creates turbulence that is intended to augment the heat transfer along the combustion liner aft end. First plurality of cooling holes 47 are relatively large in size in order to provide a sufficient amount of cooling air to channel 56 and onto attachment region 54

Combustion liner 40 is positioned within transition duct 41 such that at least one outer seal 53 is in contact with first inner wall 45 of inlet ring 42. Outer seal 53 includes a plurality of openings that allow for cooling air to pass through outer seal 53 to cool outer wall 52 of combustion liner 40.

For the preferred embodiment of the present invention, first plurality of cooling holes 47 is oriented normal, or perpendicular, to first outer wall 46 of inlet ring 42 and comprise at least twenty-five holes, circular in cross section, and having a first diameter of at least 0.050 inches. First plurality of cooling holes 47 inject a cooling fluid, such as air, onto attachment region 54 of second outer wall 52 of combustion liner 40 proximate second aft end 50 to provide the necessary cooling to lower the metal temperatures of combustion liner 40 proximate aft end 50. Lower metal temperatures along the combustion liner aft end, will reduce the amount of liner movement towards the transition duct, thereby reducing the amount of interference, and resulting wear, between the outer seal and transition duct. As a result of the geometric changes to the combustion liner and enhanced cooling through the transition duct inlet ring, metal temperatures have been reduced and component life has been increased for outer seal 53.

Figure 4:
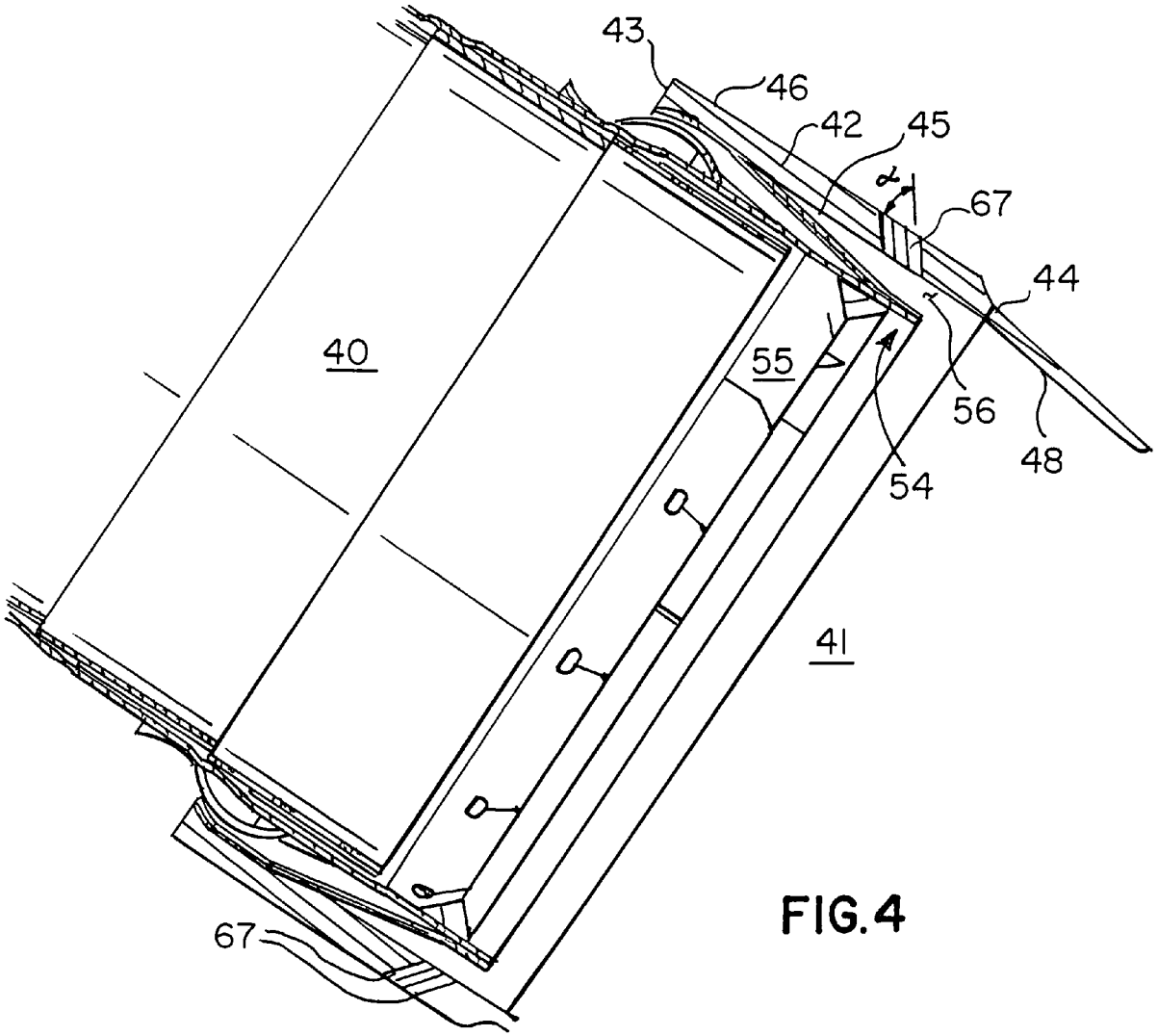
FIG. 4 is a detailed cross section view of the interface region between a combustion liner and a transition duct for a gas turbine combustor in accordance with a first alternate embodiment of the present invention.

A first alternate embodiment of the present invention is shown in a detailed cross section in FIG. 4. The first alternate embodiment includes most of the elements of the preferred embodiment with the exception of the orientation of the first plurality of cooling holes. Transition duct 41 includes an inlet ring 42 that has having a first forward end 43, a first aft end 44, a first inner wall 45, a first outer wall 46, and a first plurality of cooling holes 67 that extend from first outer wall 46 to first inner wall 45 and are proximate first aft end 44 of inlet ring 42. In the first alternate embodiment, first plurality of cooling holes 67 are oriented at an acute angle $\alpha$ relative to first outer wall 46 of inlet ring 42. Using angled cooling holes as opposed to cooling holes normal to first outer wall 46 allows for improved cooling to inlet ring 42 due to the longer hole length and its inherently greater surface area. Furthermore, orienting first plurality of cooling holes 67 at an angle $\alpha$ allows the cooling fluid to be directed as a film along transition duct inner wall 68. As one skilled in the art of heat transfer and combustion will understand, the exact value of angle $\alpha$ and the quantity and diameter of cooling holes 67 will depend on the desired level of heat transfer and cooling. However, for use in a combustor similar to that shown in FIG. 1, first plurality of cooling holes 67 comprises at least fifty holes, circular in cross section, each with a first diameter of at least 0.040 inches.

Figure 5:
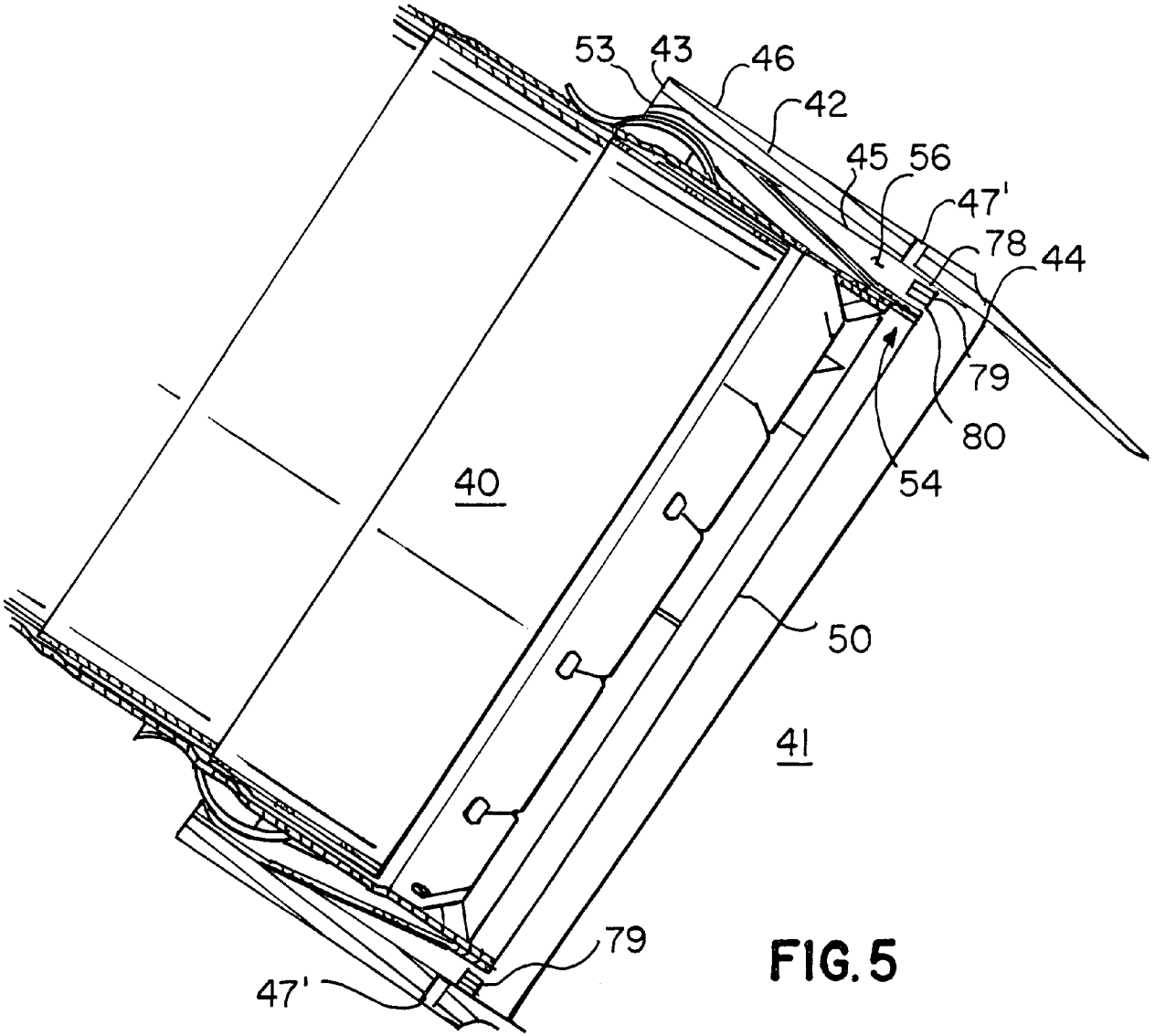
FIG. 5 is a detailed cross section view of the interface region between a combustion liner and a transition duct for a gas turbine combustor in accordance with a second alternate embodiment of the present invention.

A second alternate embodiment is shown in detail in FIG. 5. As with the first alternate embodiment, the second alternate embodiment includes most of the elements of the preferred embodiment, but includes the additional limitation of a sealing ring. Transition duct 41 includes an inlet ring 42 having a first forward end 43, a first aft end 44, a first inner wall 45, a first outer wall 46, and a first plurality of cooling holes 47' that extend from first outer wall 46 to first inner wall 45 and are proximate first aft end 44 of inlet ring 42. First plurality of cooling holes 47' are oriented generally normal, or perpendicular, to first outer wall 46, however, cooling holes 47' are smaller in diameter and fewer in quantity than the preferred embodiment shown in FIG. 3. Aft region 54 still receives adequate cooling despite the small cooling holes due to the addition of sealing ring 78, which is fixed to first inner wall 45 proximate first aft end 44. Sealing ring 78 serves to reduce the size of gap 80 between attachment region 54 and first inner wall 45 of transition duct inlet ring 42, thereby minimizing the inflow of hot re-circulated gases into channel 56 from combustion liner 40. In the prior art combustor this re-circulation effect prevented sufficient cooling of the outer seal and aft section of the combustion liner. For the embodiments that include a sealing ring, a permissible size for gap 80 is up to 0.100 inches. Sealing ring 78 also includes a second plurality of cooling holes 79 that are generally perpendicular to first plurality of cooling holes 47'. The second plurality of cooling holes direct the air from first plurality of cooling holes 47' to transition duct 41 and cool sealing ring 78 in the process. As previously mentioned, for this second alternate embodiment, fewer cooling holes are found in the first plurality of cooling holes 47' due to the addition of sealing ring 78. For this embodiment, roughly half as many cooling holes are required, or at least twelve holes, when used in combination with sealing ring 78 and the first plurality of cooling holes have a first diameter of at least 0.025 inches.

Figure 6:
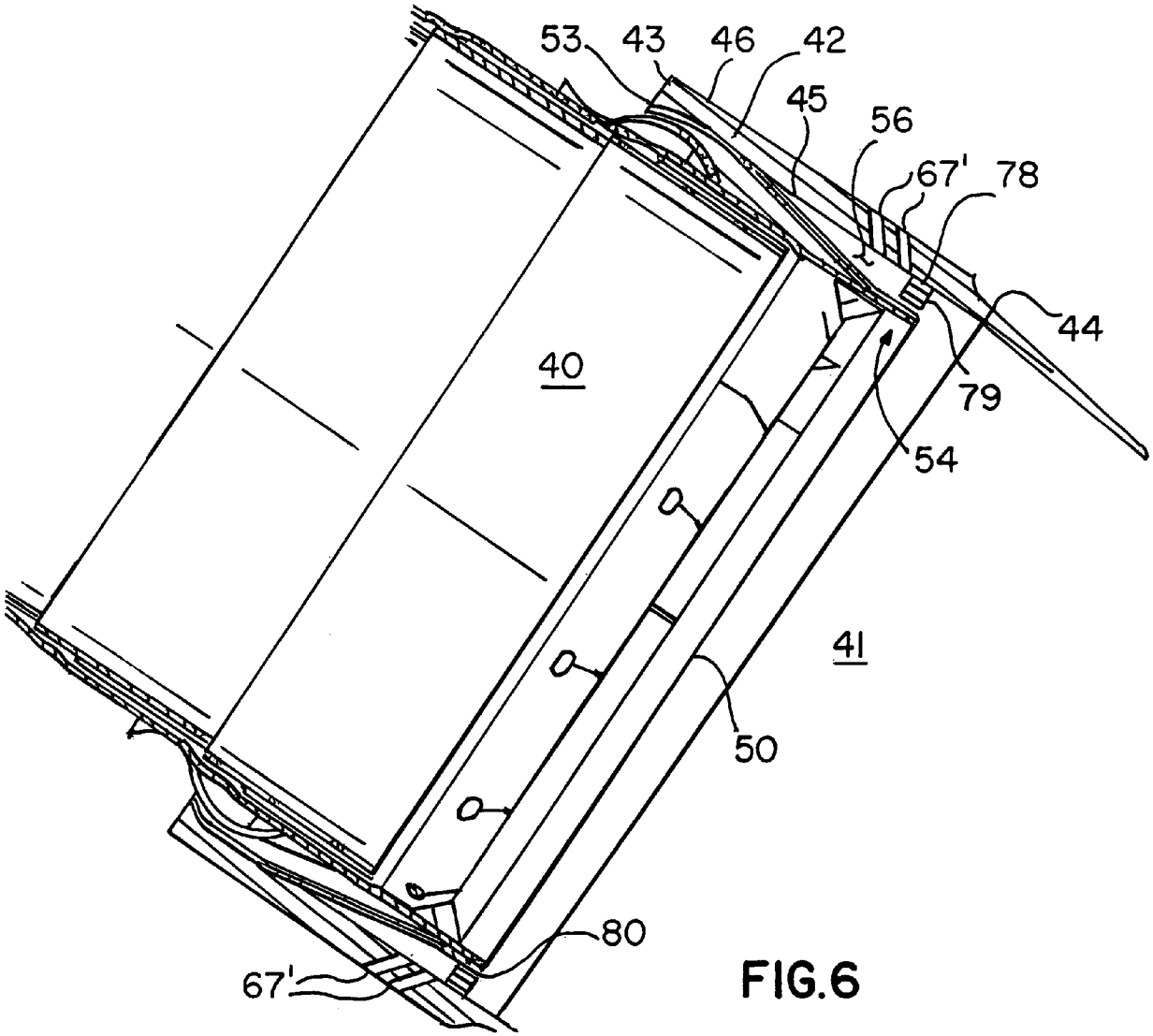
FIG. 6 is a detailed cross section view of the interface region between a combustion liner and a transition duct for a gas turbine combustor in accordance with a third alternate embodiment of the present invention.

A third alternate embodiment of the present invention is shown in a detailed cross section in FIG. 6. The third alternate embodiment incorporates elements of the first and second alternate embodiments including the use of angled cooling holes and a sealing ring to prevent the re-circulation of hot combustion gases into the region between the combustion liner and transition duct inlet ring. Transition duct 41 includes an inlet ring 42 having a first forward end 43, a first aft end 44, a first inner wall 45, a first outer wall 46, and a first plurality of cooling holes 67' that extend from first outer wall 46 to first inner wall 45 and are proximate first aft end 44 of inlet ring 42. In the third alternate embodiment, first plurality of cooling holes 67' are oriented at an acute angle $\alpha$ relative to first outer wall 46 of inlet ring 42. Using angled cooling holes as opposed to cooling holes normal to first outer wall 46 allows for improved cooling to inlet ring 42 due to the longer hole length and its inherently greater surface area. As one skilled in the art of heat transfer and combustion will understand, the exact value of angle $\alpha$ and the quantity and diameter of first plurality of cooling holes 67' will depend on the desired level of heat transfer and cooling, but for this embodiment, there is at least twenty-five holes, each with a first diameter of 0.020 inches. As with the second alternate embodiment, transition duct inlet ring 42 also includes sealing ring 78 for preventing hot combustion gases from re-circulating into channel 56. Sealing ring 78 includes a second plurality of cooling holes 79 that are oriented generally perpendicular to first plurality of cooling holes 67' for cooling sealing ring 78.

Figure 7:
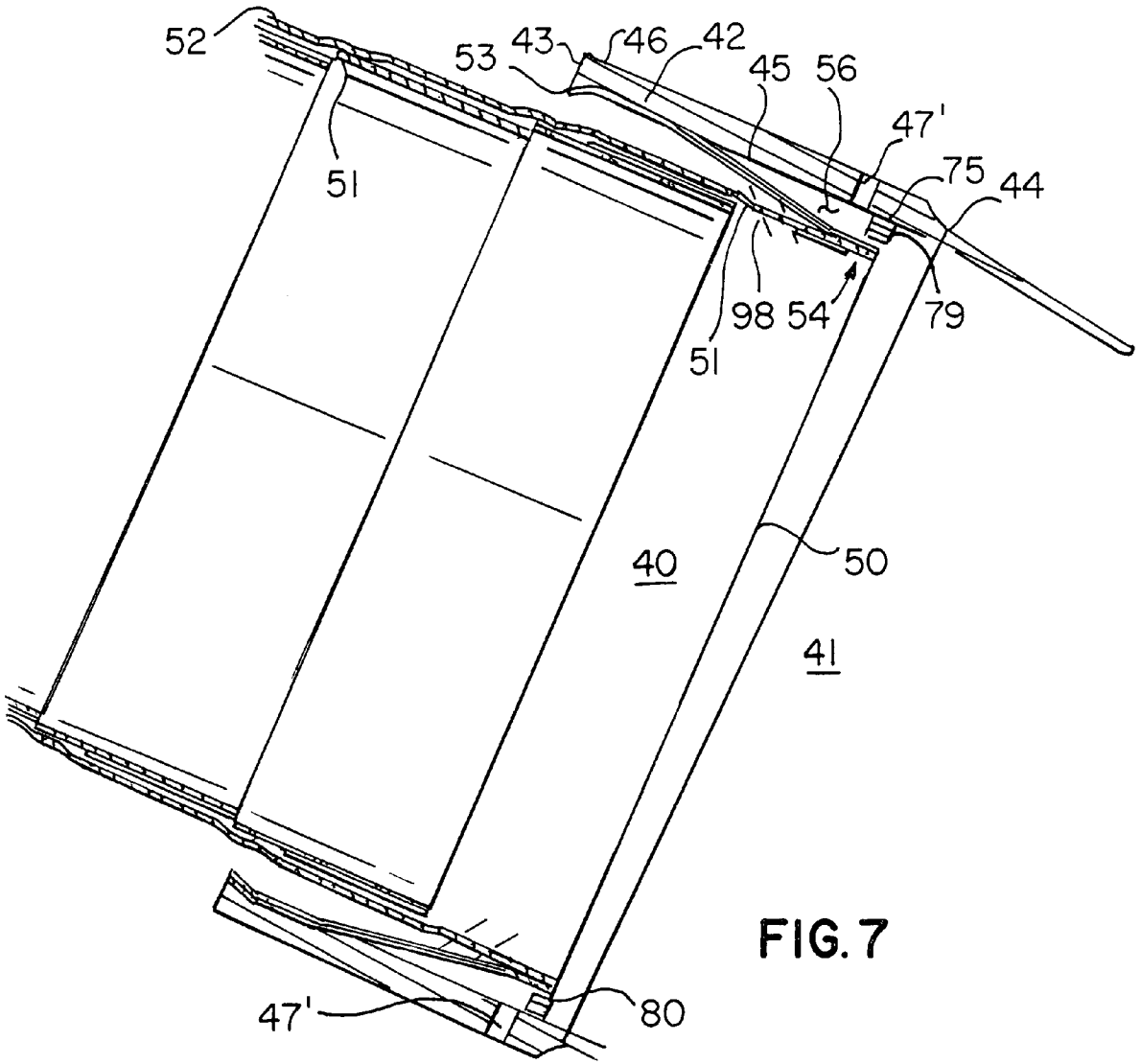
FIG. 7 is a detailed cross section view of the interface region between a combustion liner and a transition duct for a gas turbine combustor in accordance with a fourth alternate embodiment of the present invention.

A fourth alternate embodiment of the present invention is shown in detail in FIG. 7. The fourth alternate embodiment incorporates elements of the second alternate embodiment including the use of cooling holes perpendicular to the transition duct inlet ring and a sealing ring. Transition duct 41 includes an inlet ring 42 having a first forward end 43, a first aft end 44, a first inner wall 45, a first outer wall 46, and a first plurality of cooling holes 47' that extend from first outer wall 46 to first inner wall 45 and are proximate first aft end 44 of inlet ring 42. In the fourth alternate embodiment, first plurality of cooling holes 47', comprising at least twelve holes having a diameter of at least 0.025 inches, are oriented normal to first outer wall 46 of inlet ring 42. As with the second alternate embodiment, transition duct inlet ring 42 also includes sealing ring 78 for preventing hot combustion gases from re-circulating into channel 56. Sealing ring 78 includes a second plurality of cooling holes 79 that are oriented generally perpendicular to first plurality of cooling holes 47' for cooling sealing ring 78. The fourth alternate embodiment also includes a third plurality of cooling holes 98 located in second inner wall 51 of combustion liner 40 proximate second aft end 50 and extending from second outer wall 52 to second inner wall 51. Third plurality of cooling holes 98 are oriented at an angle $\beta$ relative to second inner wall 51, with angle $\beta$ preferably less than 90 degrees and oriented towards aft end 50 of combustion liner 40. Cooling fluid passes from channel 56 through third plurality of cooling holes 98 to lay a film of cooling air along inner wall 51.

Figure 8:
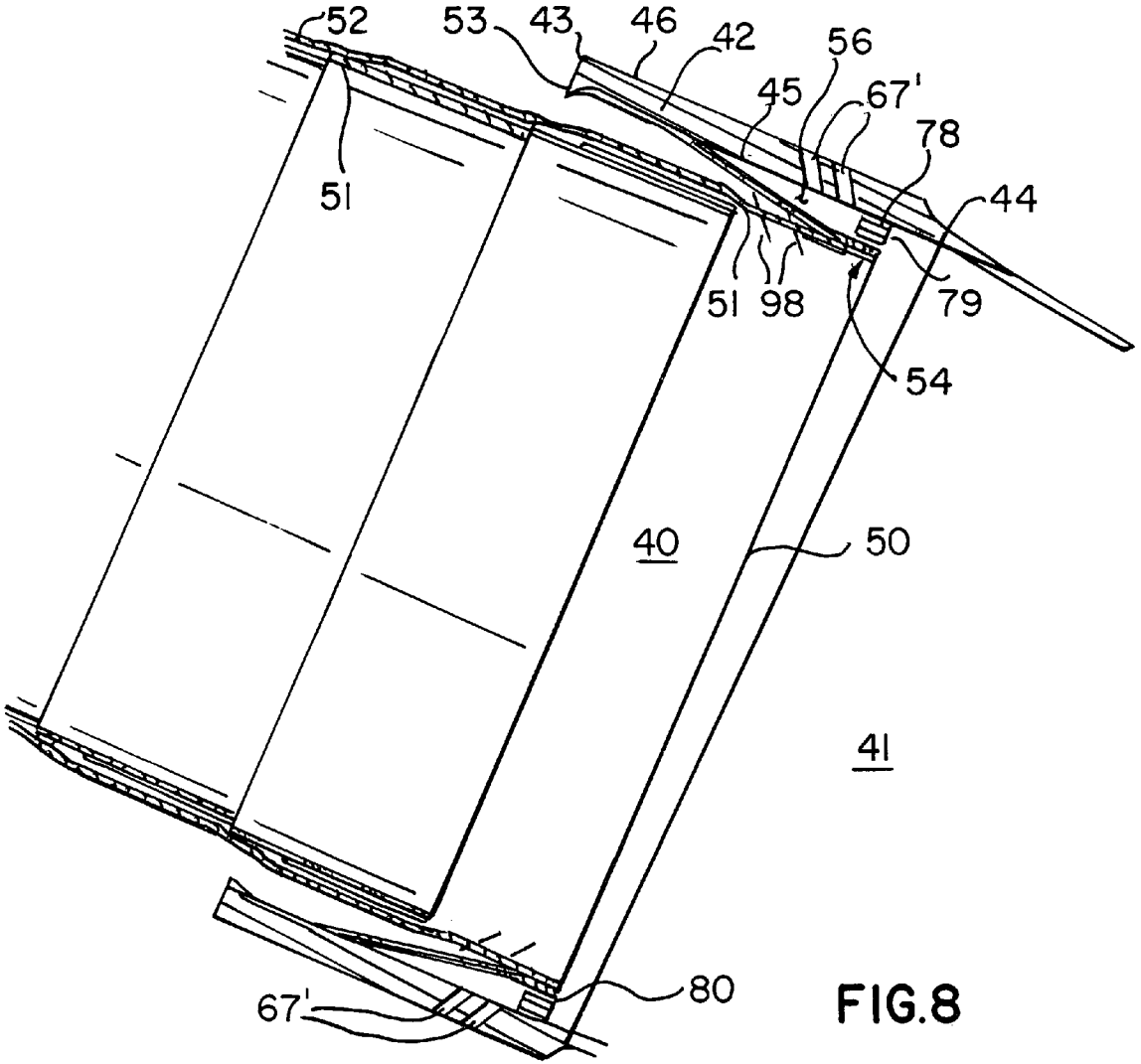
FIG. 8 is a detailed cross section view of the interface region between a combustion liner and a transition duct for a gas turbine combustor in accordance with a fifth alternate embodiment of the present invention.

A fifth alternate embodiment of the present invention is shown in detail in FIG. 8. The fifth alternate embodiment incorporates elements of the third alternate embodiment including the use of angled cooling holes in the transition duct inlet ring and a sealing ring. Transition duct 41 includes an inlet ring 42 having a first forward end 43, a first aft end 44, a first inner wall 45, a first outer wall 46, and a first plurality of cooling holes 67' that extend from first outer wall 46 to first inner wall 45 and are proximate first aft end 44 of inlet ring 42. In the fifth alternate embodiment, first plurality of cooling holes 67' are oriented at an acute angle $\alpha$ relative to first outer wall 46 of inlet ring 42. Using angled cooling holes as opposed to cooling holes normal to first outer wall 46 allows for improved cooling to inlet ring 42 due to the longer hole length and its inherently greater surface area. As one skilled in the art of heat transfer and combustion will understand, the exact value of angle $\alpha$ and the quantity and diameter of first plurality of cooling holes 67' will depend on the desired level of heat transfer and cooling, but for this embodiment, there is at least twenty-five holes, each with a first diameter of 0.020 inches.

As with the second alternate embodiment, transition duct inlet ring 42 also includes sealing ring 78 for preventing hot combustion gases from re-circulating into channel 56. Sealing ring 78 includes a second plurality of cooling holes 79 that are oriented generally perpendicular to first plurality of cooling holes 67' for cooling sealing ring 78. The fifth alternate embodiment also includes a third plurality of cooling holes 98 located in second inner wall 51 of combustion liner 40 proximate second aft end 50 and extending from second outer wall 52 to second inner wall 51. Third plurality of cooling holes 98 are oriented at an angle $\beta$ relative to second inner wall 51, with angle $\beta$ preferably less than 90 degrees and oriented towards aft end 50 of combustion liner 40. Cooling fluid passes from channel 56 through third plurality of cooling holes 98 to lay a film of cooling air along inner wall 51.

Each of the embodiments described herein incorporate cooling enhancements to the interface region between a combustion liner and transition duct in various combinations depending on the desired level of cooling, the amount of air available for cooling, and combustion liner aft end geometry. For example, if cooling air supply is not limited and minimal geometry modifications to the combustion liner and transition duct are desired the preferred embodiment for enhancing the cooling to the interface region could be used. On the other hand, if modifications to the combustion liner and transition duct geometry are not limiting factors, yet cooling air supply is limited and must be used most efficiently, then the fifth alternate embodiment, which is a more aggressive and advanced cooling design, could be selected.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What is claimed is:

1. An interface region between a combustion liner and a transition duct having improved cooling, said interface region comprising:

a transition duct having an inlet ring, said inlet ring having a first forward end, a first aft end, a first inner wall, a first outer wall, a first plurality of cooling holes extending from said first outer wall to said first inner wall, said first cooling holes proximate said first aft end of said inlet ring, and a sealing ring fixed to said first inner wall proximate said first aft end, said sealing ring having a second plurality of cooling holes;

a combustion liner having a second forward end, a second aft end, a plurality of openings proximate said second forward end for a plurality of fuel injectors, a second inner wall, a second outer wall, a deflector ring fixed to said second inner wall, and at least one outer seal, said at least one outer seal having a plurality of openings, said outer seal fixed to said combustion liner along said second outer wall at an attachment region proximate said second aft end, said combustion liner telescopically received within said transition duct such that said at least one outer seal is in contact with said first inner wall of said transition duct inlet ring;

wherein said first plurality of cooling holes inject a cooling fluid onto said attachment region of said second outer wall of said combustion liner proximate said second aft end.

2. The interface region of claim 1 wherein said first plurality of cooling holes are normal to said first outer wall of said inlet ring.

3. The interface region of claim 2 wherein said first plurality of cooling holes comprises at least twelve holes.

4. The interface region of claim 3 wherein said first plurality of cooling holes have a first diameter of at least 0.025 inches.

5. The interface region of claim 1 wherein said second plurality of cooling holes are generally perpendicular to said first plurality of cooling holes.

6. The interface region of claim 1 wherein said first plurality of cooling holes are oriented at an acute angle $\alpha$ relative to said first outer wall of said inlet ring.

7. The interface region of claim 6 wherein said first plurality of cooling holes comprises at least twenty-five holes.

8. The interface region of claim 7 wherein said first plurality of cooling holes have a first diameter of at least 0.020 inches.

9. The interface region of claim 1 wherein said sealing ring and said second outer wall of said combustion liner are separated by a gap up to 0.100 inches.

10. An interface region between a combustion liner and a transition duct having improved cooling, said interface region comprising:

a transition duct having an inlet ring, said inlet ring having a first forward end, a first aft end, a first inner wall, a first outer wall, a first plurality of cooling holes extending from said first outer wall to said first inner wall, said first plurality of cooling holes proximate said first aft end of said inlet ring, and a sealing ring fixed to said first inner wall proximate said first aft end, said sealing ring having a second plurality of cooling holes;

a combustion liner having a second forward end, a second aft end, a plurality of openings proximate said second forward end for a plurality of fuel injectors, a second inner wall, a second outer wall, and at least one outer seal, said at least one outer seal having a plurality of openings, said outer seal fixed to said combustion liner along said second outer wall at an attachment region proximate said second aft end, said combustion liner having a third plurality of cooling holes located proximate said second aft end and extending from said second outer wall to said second inner wall, wherein said third plurality of cooling holes are oriented at an angle $\beta$ relative to said second inner wall, said combustion liner telescopically received within said transition duct such that said at least one outer seal is in contact with said first inner wall of said transition duct inlet ring;

wherein said first plurality of first cooling holes inject a cooling fluid onto said attachment region of said second outer wall of said combustion liner proximate said second aft end.

11. The interface region of claim 10 wherein said first plurality of cooling holes are normal to said first outer wall of said inlet ring.

12. The interface region of claim 11 wherein said first plurality of cooling holes comprises at least twelve holes.

13. The interface region of claim 12 wherein said first plurality of cooling holes have a first diameter of at least 0.025 inches.

14. The interface region of claim 10 wherein said second plurality of cooling holes are generally perpendicular to said first plurality of cooling holes.

15. The interface region of claim 10 wherein said first plurality of cooling holes are oriented at an acute angle $\alpha$ relative to said first outer wall of said inlet ring.

16. The interface region of claim 15 wherein said first plurality of cooling holes comprises at least twenty-five holes.

17. The interface region of claim 16 wherein said first plurality of cooling holes have a first diameter of at least 0.020 inches.

18. The interface region of claim 10 wherein said sealing ring and said second outer wall of said combustion liner are separated by a gap up to 0.100 inches.

19. The interface region of claim 10 wherein said angle $\beta$ of said third plurality of holes is less than 90 degrees.

20. The interface region of claim 10 wherein said third plurality of cooling holes comprises at least fifty holes.

21. The interface region of claim 20 wherein said third plurality of cooling holes have a third diameter of at least 0.020 inches.

* * * * *